US012405064B2

(12) United States Patent
Jensen

(10) Patent No.: US 12,405,064 B2
(45) Date of Patent: Sep. 2, 2025

(54) HEAT EXCHANGER INCLUDING CROSS CHANNEL COMMUNICATION

(71) Applicant: Honeywell International Inc., Charlotte, NC (US)

(72) Inventor: Joseph Jensen, Torrance, CA (US)

(73) Assignee: Honeywell International Inc., Charlotte, NC (US)

( * ) Notice: Subject to any disclaimer, the term of this patent is extended or adjusted under 35 U.S.C. 154(b) by 65 days.

(21) Appl. No.: 18/052,792

(22) Filed: Nov. 4, 2022

(65) Prior Publication Data

US 2024/0151476 A1 May 9, 2024

(51) Int. Cl.
*F28D 9/00* (2006.01)

(52) U.S. Cl.
CPC ..... *F28D 9/0075* (2013.01); *F28F 2250/04* (2013.01)

(58) Field of Classification Search
CPC .... F28F 9/0209; F28F 2250/04; F28D 9/0075
See application file for complete search history.

(56) References Cited

U.S. PATENT DOCUMENTS 5,323,851 A * 6/1994 Abraham ..... B21C 37/151 165/177
5,704,415 A * 1/1998 Suzuki ..... F28F 9/0221 29/890.032
8,167,028 B2 5/2012 Raver
8,794,571 B2 8/2014 Baumgardt et al.
9,835,380 B2 12/2017 Kupiszewski et al.
2002/0174979 A1* 11/2002 Haegele ..... F28D 1/0391 165/177
2004/0055329 A1* 3/2004 Mathias ..... F25J 1/0262 62/611
2005/0274501 A1* 12/2005 Agee ..... F28F 13/14 165/146
2006/0048921 A1* 3/2006 Usui ..... F28D 7/1684 165/109.1

(Continued)

FOREIGN PATENT DOCUMENTS

CN 203980991 U * 12/2014
JP 08285486 A * 11/1996

(Continued)

OTHER PUBLICATIONS

Translation of Japanese Patent Document JP2017045857A named Translation-JP2017045857A (Year: 2017).*

(Continued)

*Primary Examiner* — Paul Alvare
(74) *Attorney, Agent, or Firm* — Shumaker & Sieffert, P.A.

(57) ABSTRACT

In some examples, a heat exchanger includes a first flow channel having a first flow channel inlet and a first flow channel outlet. The heat exchanger also includes a second flow channel having a second flow channel inlet and a second flow channel outlet. A fin may separate the first flow channel from the second flow channel. The fin may define at least one aperture configured to allow fluid to flow between the first flow channel and the second flow channel if one of the first flow channel inlet or second flow channel inlet becomes constricted through a buildup of foreign object debris.

9 Claims, 5 Drawing Sheets

(56) References Cited

U.S. PATENT DOCUMENTS

| | | | | |
|---|---|---|---|---|
| 2009/0139693 | A1* | 6/2009 | Qu | F28F 3/048 165/80.4 |
| 2009/0260789 | A1 | 10/2009 | Sperandei et al. | |
| 2011/0132570 | A1 | 6/2011 | Wilmot | |
| 2013/0220587 | A1* | 8/2013 | Tamura | F28F 3/022 165/185 |
| 2016/0025425 | A1 | 1/2016 | Army, Jr. et al. | |
| 2018/0112933 | A1* | 4/2018 | Takagi | F28D 1/0333 |
| 2019/0162483 | A1* | 5/2019 | Ono | F28F 3/048 |
| 2021/0071959 | A1 | 3/2021 | Streeter et al. | |
| 2021/0239403 | A1* | 8/2021 | Noishiki | F28D 9/0037 |
| 2021/0254896 | A1* | 8/2021 | Borghese | F28F 21/084 |
| 2024/0151476 | A1* | 5/2024 | Jensen | F28D 9/0075 |

FOREIGN PATENT DOCUMENTS

| | | | | |
|---|---|---|---|---|
| JP | 2004061065 | A | | 2/2004 |
| JP | 4857074 | B2 | | 1/2012 |
| JP | 2012083026 | A | | 4/2012 |
| JP | 2017045857 | A | * | 3/2017 |
| JP | 2017133718 | A | | 8/2017 |
| JP | 2017142033 | A | * | 8/2017 |
| JP | 6991567 | B2 | | 1/2022 |
| WO | WO-03005471 | A2 | * | 1/2003 ..... H01M 8/0612 |
| WO | WO-2010115246 | A2 | * | 10/2010 ..... B01D 53/265 |
| WO | WO-2015084027 | A1 | * | 6/2015 ..... G21C 15/18 |

OTHER PUBLICATIONS

Extended Search Report from counterpart European Application No. 23202967.8 dated Mar. 14, 2024, 6 pp.

Response to Extended Search Report dated Mar. 14, 2024, from counterpart European Application No. 23202967.8 filed May 28, 2024, 14 pp.

Response to Communication pursuant to Article 94(3) EPC dated Nov. 4, 2024, from counterpart European Application No. 23202967.8 filed Feb. 14, 2025, 12 pp.

Communication pursuant to Article 94(3) EPC from counterpart European Application No. 23202967.8 dated Nov. 4, 2024, 6 pp.

Communication pursuant to Article 94(3) EPC from counterpart European Application No. 23202967.8 dated Jun. 12, 2025, 4 pp.

Response to Communication pursuant to Article 94(3) EPC dated Jun. 12, 2025, from counterpart European Application No. 23202967.8 filed Jul. 25, 2025, 31 pp.

* cited by examiner

HEAT EXCHANGER INCLUDING CROSS CHANNEL COMMUNICATION

TECHNICAL FIELD

The present disclosure relates to heat exchangers.

BACKGROUND

Vehicles may include various systems that work together to provide power to the vehicle. For example, a vehicle such as an aircraft may include a gas turbine engine and systems that support the gas turbine engine in the generation of power to power an aircraft. Due to the operating systems associated with the vehicle, one or more heat exchanger may be employed to control a temperature of various fluids associated with the vehicle. In certain instances, due to the location of the heat exchanger on the vehicle, a size of the heat exchanger may be restricted to fit within a given space onboard the vehicle. Furthermore, the circumstances may sometimes dictate that the heat exchanger be located in a place on board the vehicle that is subject to conditions including elevated temperatures, pressures, or external conditions including dust, sand, ice, hail, or the like. The heat exchanger may be manufactured to function in such a hostile environment.

SUMMARY

In some examples, the disclosure relates to a heat exchanger which includes adjacent flow channels separated by a fin, and a method of manufacturing a heat exchanger. The heat exchanger may include a fin which defines at least one aperture configured to allow fluid to flow between a first flow channel and a neighboring second flow channel. In operation, if an inlet of the first flow channel or an inlet of the second flow channel becomes constricted, such as when the heat exchanger is included on a rotary wing aircraft (e.g., a helicopter) or another vehicle that may operate in a sandy or dusty environment where foreign object debris (FOD) may be ingested by the heat exchanger, the flow through said flow channel will be reduced. Inclusion of a heat exchanger fin or fins which define an aperture or apertures that allow for fluid to flow between channels may mitigate or eliminate efficiency losses due to FOD constriction or blockage, without significant increases in size or weight of the heat exchanger. In fact, the resulting heat exchanger may advantageously be lighter than a similar heat exchanger that does not include apertures configured to allow for cross channel communication.

In some examples, the disclosure relates to a heat exchanger which includes a first flow channel having a first flow channel inlet and a first flow channel outlet. The heat exchanger also includes a second flow channel having a second flow channel inlet and a second flow channel outlet. A fin separates the first flow channel from the second flow channel. The fin defines at least one aperture configured to allow fluid to flow between the first flow channel and the second flow channel if one of the first flow channel inlet or second flow channel inlet becomes constricted through a buildup of one or more of sand, foreign object debris (FOD), or other contaminants.

In some examples, the disclosure is directed to a technique for manufacturing a heat exchanger. The technique includes forming a first flow channel having a first flow channel inlet and a first flow channel outlet. The technique also includes forming a second flow channel, the second flow channel having a first flow channel inlet and a first flow channel outlet. The technique includes separating the first flow channel from the second flow channel with a fin. The fin defines at least one aperture which allows the fluid to flow between the first flow channel and the second flow channel if one of the first flow channel inlet or second flow channel inlet becomes constricted through a buildup of one or more of sand, foreign object debris (FOD), or other contaminants.

This summary is intended to provide an overview of the subject matter described in this disclosure. It is not intended to provide an exclusive or exhaustive explanation of the systems, devices, and methods described in detail within the accompanying drawings and description below. Further details of one or more examples are set forth in the accompanying drawings and the description below. Other features, objects, and advantages will be apparent from the description and drawings, and from the statements provided below.

DETAILED DESCRIPTION

In some examples, the disclosure describes heat exchangers and techniques for making such heat exchangers. Heat exchangers are employed in a variety of applications, including vehicles (e.g., aircraft such as helicopters) which operate in extreme environments at extreme temperatures. The disclosed heat exchangers may also be used in environmental control systems (ECS), or in stationary applications operating in extreme environments. Due to the operating conditions associated with the vehicle, the size of the heat exchanger may be restricted to fit within a given space onboard the vehicle. The restriction in size of the heat exchanger may result in limited heat transfer. Accordingly, it is desirable to provide a heat exchanger that is sized to fit within a restricted space onboard a vehicle, while providing the required heat transfer that meets the needs of a particular working fluid. In addition, it is desirable to minimize a weight of a heat exchanger or heat exchangers of a particular vehicle.

Some extreme environments mentioned above include environments where foreign object debris (FOD) may be ingested by the heat exchanger. FOD generally refers to any solid material or particle in the fluid stream entering the heat exchanger. For example, FOD may include, but is not limited to, sand, dust, pebbles, ice, hail, other contaminants, combinations thereof, or the like. There is increasing demand for vehicles, such as aircraft (e.g., rotary wing aircraft such as a helicopter), to operate in such environments. Therefore, there is a need to provide a heat exchanger which mitigates or eliminates the deleterious effects of FOD, which may include reduced efficiency of the heat exchanger due to constriction or plugging of heat exchanger flow channels.

One way to address problems associated with FOD contamination without increasing size of the heat exchanger is to make a flow channel inlet and the associated flow channel larger in cross-sectional area, such that FOD (e.g., a pebble) may more easily pass through the device without becoming hung up and constricting the fluid path through the flow channel. However, increasing the cross-section of the flow channel may reduce efficiency of the heat exchanger by reducing available surface area for heat transfer, so increasing the cross-section of the heat exchanger may not be desirable or possible within the limits of certain applications.

Heat exchangers according to the present disclosure may address problems associated with FOD contamination by including one or more apertures in a fin separating flow channels, promoting cross channel fluid communication. As such, heat exchangers according to the present disclosure may deliver improved heat exchanger efficiency while operating in an environment where FOD ingestion may occur, while mitigating or eliminating the overall heat transfer efficiency losses due to reduced effective heat transfer area.

Figure 1:
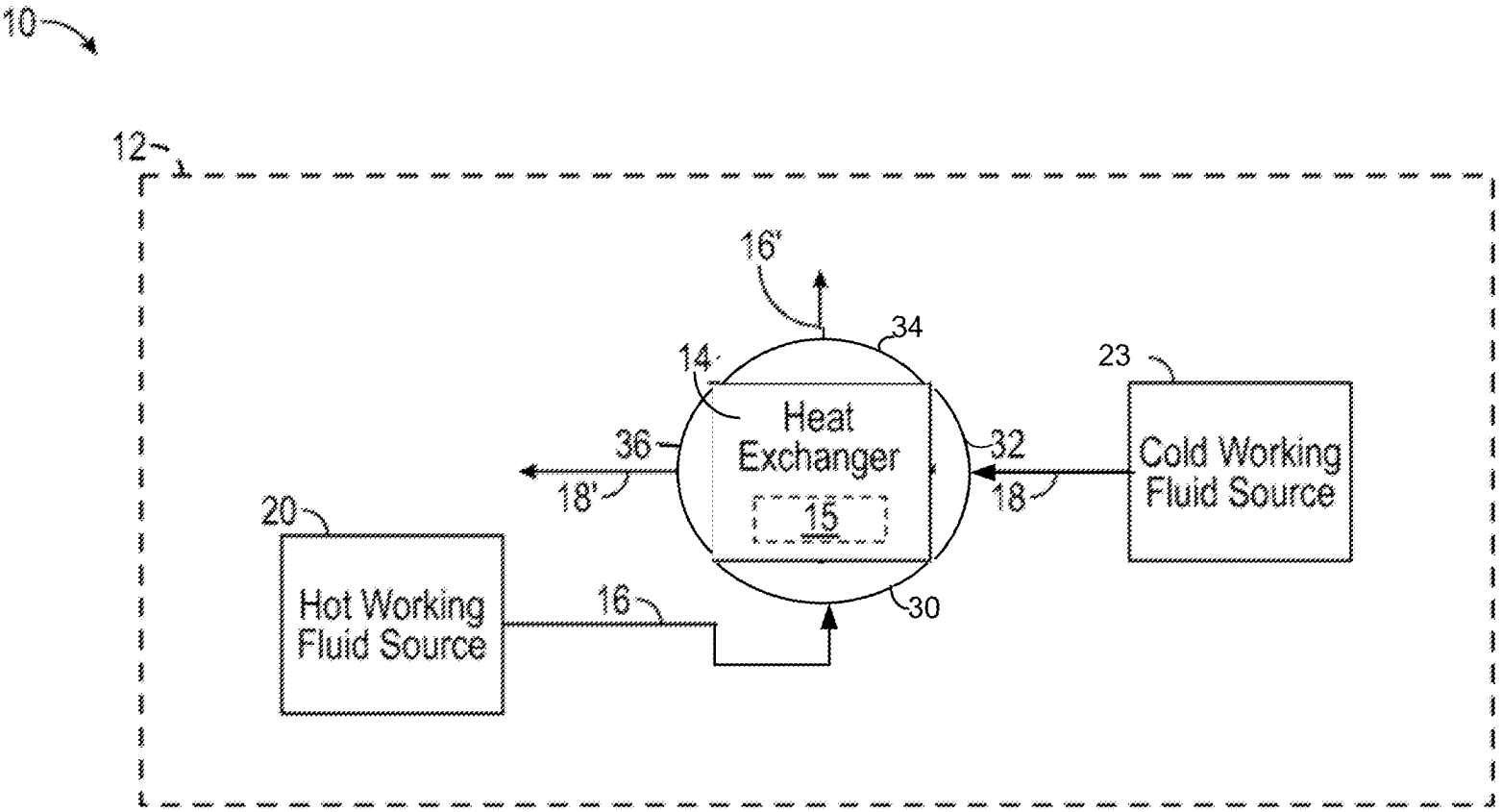
FIG. 1 is a functional block diagram of a thermodynamic system, which, in some examples, is onboard a vehicle and includes an exemplary heat exchanger according to the present disclosure.

With reference to FIG. 1, a functional block diagram of thermodynamic system 10 onboard vehicle 12, which may be an aircraft such as a helicopter, is shown. In this example, thermodynamic system 10 includes heat exchanger 14, which transfers heat from hot working fluid 16 to cold working fluid 18 to reduce a temperature of hot working fluid 16. Hot working fluid 16 is provided from hot fluid source 20, while cold working fluid 18 is provided from cold fluid source 23. In some examples, hot fluid source 20 includes, but is not limited to: a compressor section associated with the gas turbine engine that supplies compressed air as hot working fluid 16; a lubrication system that supplies engine lubrication fluid, such as oil, as hot working fluid 16; an electronic system that supplies coolant as hot working fluid 16; etc. In some examples, cold fluid source 23 may include, but is not limited to: a fan of a gas turbine engine associated with vehicle 12 that supplies fan air as cold working fluid 18; a ram air inlet associated with vehicle 12 that supplies atmospheric air as cold working fluid 18; a refrigerated coolant supply associated with vehicle 12 that supplies refrigerated coolant as cold working fluid 18; etc. It should be noted that although described herein as a single heat exchanger 14 within a single thermal management system 10 onboard vehicle 12, in some examples, thermal management system 10 may include more than one heat exchanger 14 according to the present disclosure, and/or vehicle 12 may include more than one thermal management system 10 which includes heat exchanger 14.

As will be discussed, heat exchanger 14 receives hot working fluid 16 and cold working fluid 18, and via convective and conductive heat transfer, transfers heat from hot working fluid 16 to cold working fluid 18 to output reduced temperature working fluid 16' and increased temperature working fluid 18'. Thus, in some examples, heat exchanger 14 includes core 15 fluidically coupled to (i.e., in fluid communication with) hot manifold or inlet 30, cold manifold or inlet 32, reduced temperature hot manifold or first outlet 34, and increased temperature cold manifold or second outlet 36. As will also be discussed, given the structure of core 15 of heat exchanger 14, heat exchanger 14 may be manufactured to be positioned within limited or restricted spaces, while still providing sufficient surface area for convective heat transfer to meet the cooling requirements associated with the thermodynamic system 10 with a reduced weight. Core 15 may also provide features discussed elsewhere herein which mitigate problems associated with FOD. For example, core 15 includes a fin (not illustrated in FIG. 1) which separates adjacent flow channels within core 15. The fin defines at least one aperture configured to allow for fluidic communication of hot working fluid 16 and/or cold working fluid 18 in between an inlet of the flow channels and an outlet of the flow channels, so that if one of the flow channel inlets becomes constricted (e.g., blocked by FOD), the constricted flow channel may receive working fluid from the adjacent (less constricted) flow channel, and the working surface area associated with the constricted flow channel may continue to work (e.g., transfer heat from hot working fluid 16 to cold working fluid 18 during operation).

Generally, in the example of compressor air as hot working fluid 16, the compressor air has a temperature, which may be in excess of 600 to 1200 degrees Fahrenheit, while cold working fluid 18, for example, cooling air, has a temperature of about −50 degrees Fahrenheit to 300 degrees Fahrenheit. In this example, core 15 promotes heat transfer between hot working fluid 16 and cold working fluid 18 at a rate of about 100 to about 1000 British Thermal Units per minute (BTU/min). It should be noted that the above is merely an example, and that the values may vary based on the configuration, size and requirements of core 15 of heat exchanger 14.

In some examples, core 15 of heat exchanger 14 may include a metal or metal alloy, which may be desirable for heat conducting properties. In some examples, the metal alloy of core 15 may include, but is not limited to, aluminum, Inconel, stainless steel, titanium, copper, nickel, or mixtures and combination thereof. In some examples, core 15 of heat exchanger 14 may be integrally formed (i.e., monolithic or one-piece), and in some examples, may be formed via additive manufacturing. For example, core 15 of heat exchanger 14 may be formed via direct metal laser sintering (DMLS), however, other additive manufacturing processes may be employed, including, but not limited to micro-pen, selective laser sintering, laser wire, electron beam melting, laser engineered net shaping, direct metal deposition, etc. The core may be formed by other suitable manufacturing techniques such as brazing. In some examples, heat exchanger 14 may have total dimensions of about 2 inches (in.) to about 24 inches (in.) wide by about 2 in. to about 24 in. high by about 2 in. to 72 inches in. long. It should be noted, however, that heat exchanger 14 may have any desired width, length and height for a given space within vehicle 12 or for the particular application. It should also be noted that although the example heat exchangers illustrated and discussed herein are rectangular, the core 15 of the heat exchanger 14 and/or the heat exchanger 14 may be any desired shape (e.g., substantially cylindrical or conformal in nature).

In some examples, heat exchanger 14 may include a housing or manifolding (not pictured in FIG. 1) around core 15. The housing may include a top housing plate and a bottom housing plate which may generally define the working fluid inlets and the outlets of core 15. For example, the housing may define hot inlet 30, cold inlet 32, first outlet 34, and second outlet 36. It should be noted that although described an illustrated herein as a plate fin heat exchanger 14, heat exchanger 14 may be another type of heat exchanger that includes a first flow channel and a second flow channel which are separated by a fin.

Figure 2:
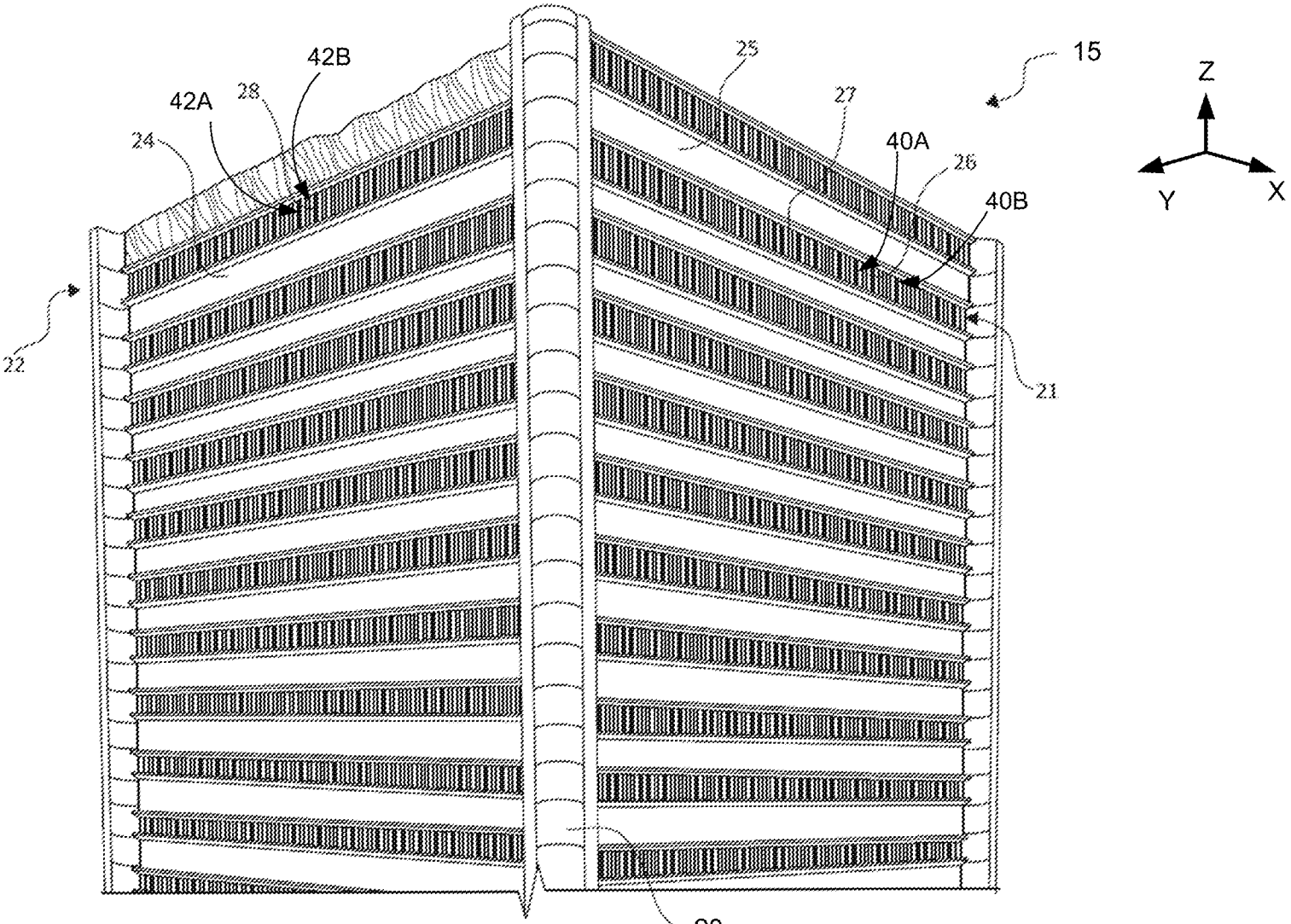
FIG. 2 is a conceptual diagram illustrating an example plate fin heat exchanger core with one side for cold flow and the other side for hot flow.

FIG. 2 is a conceptual diagram illustrating an example of a cross-flow, plate fin heat exchanger core 15 of heat exchanger 14 of FIG. 1. Core 15 may generally be described similarly with respect to FIG. 2, with additional detail as described below. Core 15 may include first or hot passages 21 (only a single hot passage is labelled) extending substantially perpendicular to second or cold passages 22 (only a single cold passage is labelled). Hot passage 21 is separated from cold passage 22 by tube sheet 27. Hot enclosure bar 24 may define (e.g., frame) hot passage 21 by defining opposing lateral sides of hot passage 21. Hot fins 26 may be positioned between hot enclosure bars 24. Similarly, cold enclosure bar 25 may define (e.g., frame) cold passage 22 by defining opposing lateral sides of cold passage 22. Cold fins 28 may be positioned between cold enclosure bar 25. Corner 29 of core 15 may define a shaped, curvilinear (e.g., defining a full circle) corner 29 or a linear, square corner having a 90-degree angle. Although described and illustrated herein primarily with respect to cross-flow, plate fin heat exchangers, it should be noted that other heat exchanger configurations are considered. For example, core 15 may define, in some examples, a counterflow arrangement, a multi-passed cross-flow arrangement, or another arrangement.

Core 15 may include a plurality of tube sheets 27 (only an individual tube sheet is labelled in FIG. 2 for clarity) which separate alternating hot passages 21 and cold passages 22 of heat exchanger core 15. Each respective cold passage 22 of core 20 includes cold enclosure bar 25 and cold fins 28 (only individual cold enclosure bar 25 and cold fin 28 are labeled for clarity). Each hot passage 21 of core 20 includes hot enclosure bar 24 and hot fins 26 (only individual hot enclosure bar 24 and hot fin 26 are labeled for clarity). Hot fin 26 separates adjacent hot channels 40A and 40B ("hot channels 40") Similarly cold fin 28 separates adjacent hot channels 42A and 42B ("cold channels 42).

Figure 3A:
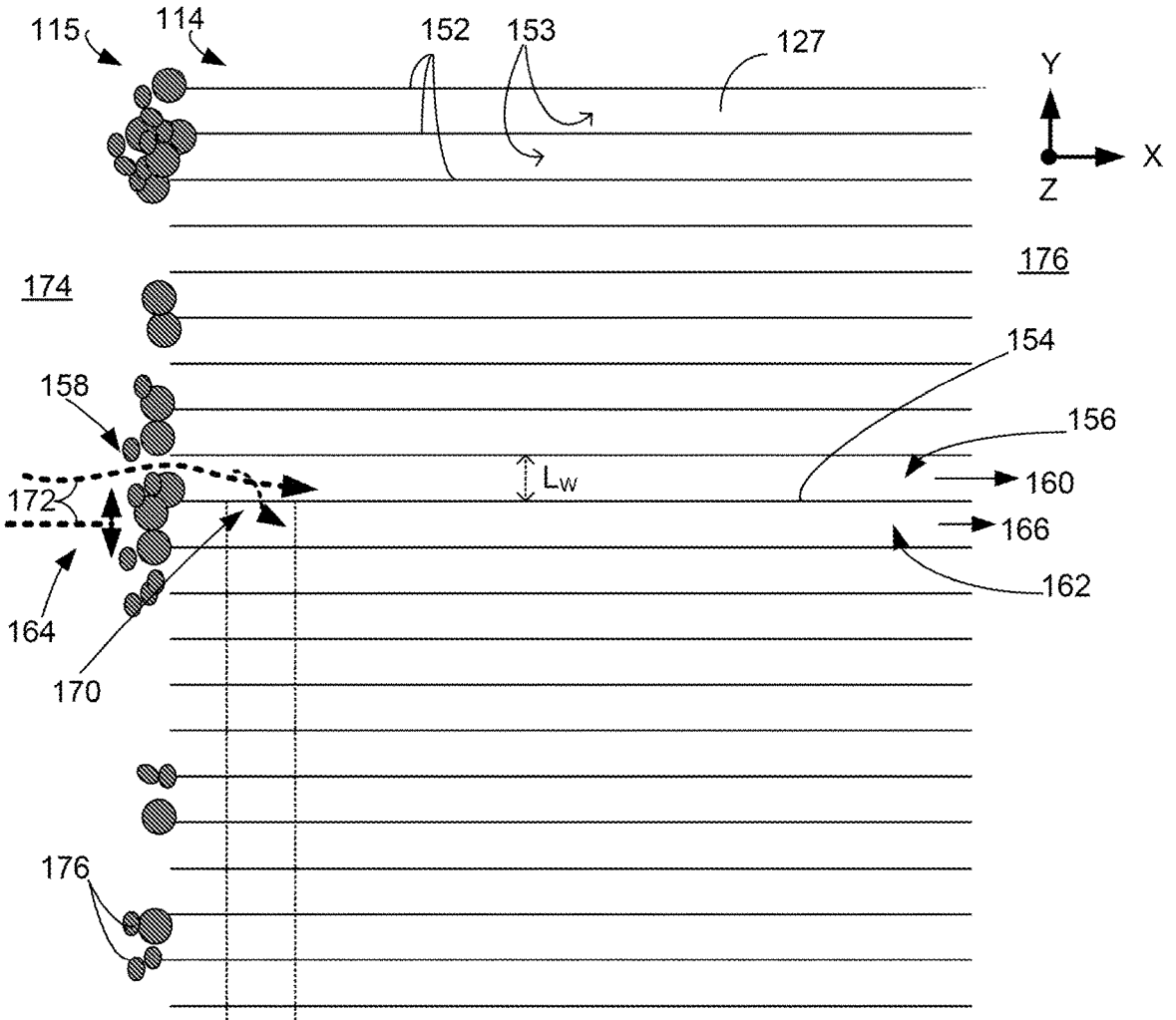
FIGS. 3A-3B illustrate a portion of an example heat exchanger which includes a fin that defines one or more apertures configured to allow for cross-channel communication, according to some examples of the present disclosure.
Figure 3B:
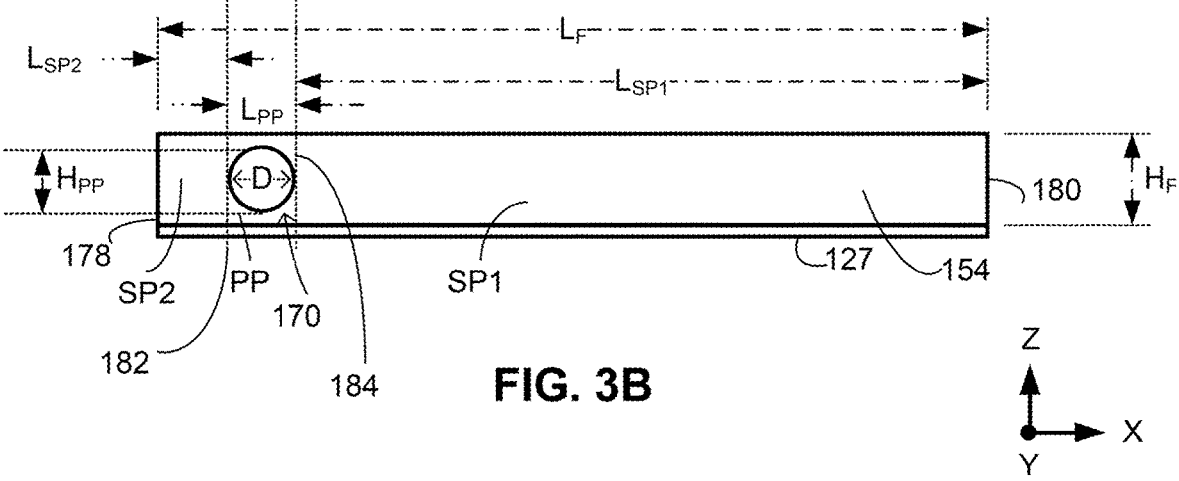

FIG. 3A is a conceptual top view of a portion of an example core 115 and example associated fins 152 looking at one fin passage. Example fins 152 may be examples of hot fins 26 or examples of cold fins 28 of FIG. 2. FIG. 3A illustrates fins 152 from a top view, located on top of tube sheet 127. FIG. 3B illustrates example fin 154 of plurality of fins 152 from a side view. Reference lines connecting FIGS. 3A and 3B are illustrated for understanding of the position of at least one aperture 170 on fin 154.

Fins 152 define a plurality of flow channels 153 in core 115 of heat exchanger 114. Flow channels 153 may combine to make up a passage, such as hot passage 21 or cold passage 22 as described above with respect to FIG. 2. Flow channels 153 guide fluid 172 (illustrated by the thick dashed line in FIG. 3A) through core 115, and may assist in distributing the flow of fluid and/or provide additional effective heat transfer surface area to improve the heat transfer efficiency of heat exchanger 114. Flow channels 152 may extend from inlet manifold 174, which may be inlet 30 or inlet 32 (FIG. 1), to outlet manifold 174, which may be first outlet 34 or second outlet 36 (FIG. 1). Although described below with respect to fin 154 separating first flow channel 156 from adjacent second flow channel 162 for brevity below, in some examples the description of fin 154 may apply to any portion (e.g., every other fin of fins 152) or all of fins 152. Similarly, the description of first flow channel 156 and second flow channel 162 may apply to any portion of flow channels 153 or all of flow channels 153.

Core 115 defines first flow channel 156, which is a passageway for fluid 172 (e.g., working fluid 16 or 18, FIG. 1) extending from first flow channel inlet 158 to first flow channel outlet 160. Core 115 further defines second flow channel 162 extending from second flow channel inlet 164 to second flow channel outlet 166. Fin 154 separates first flow channel 156 from second flow channel 158. In some examples, fin 154 may be a relatively thin wall of form about 0.001 to about 0.01 inches thick, for example from about 0.003 to about 0.005 inches thick. Fin 154 may extend in the Z-direction from a bottom tube sheet (27, FIG. 2) to a top tube sheet (27, FIG. 2).

In some examples, first flow channel 156 may define first flow channel width $L_W$, which may be defined as the distance in the Y-direction between fin 154 and an adjacent fin of fins 153 across first flow channel 156. In some examples, the distance between fin 154 and an adjacent fin may be in a range of from about 0.040 inches to about 0.400 inches, such as for example about 0.060 to about 0.100 inches. In some examples, the distance between the bottom tube sheet and the top tube sheet may be substantially similar to the distance between fin 154 and an adjacent fin, such that first flow channel 156, second flow channel 162, or both may define a substantially square cross-section. Alternatively, a distance between a top tube sheet (27, FIG. 2) and a bottom tube sheet (27, FIG. 2) may be of a larger magnitude or a smaller magnitude than the distance between fin 154 and an adjacent fin, such that first flow channel 156 may be longer in the Z-direction or shorter in the Z-direction than first flow channel 156 is wide in the Y-direction.

FIG. 3A schematically illustrates core 115 during operation in an extreme environment, as described above. In operation, FOD 176 may constrict first flow channel inlet 158 or second flow channel inlet 164, such that the flow channel 156, 162 ingests a reduced or eliminated flow of fluid 172 from inlet manifold 174. Although second flow channel 162 is illustrated and described as the constricted flow channel, core 115 is configured to operate in reverse if first flow channel 156 becomes constricted while second flow channel 162 remains open. Regardless of which flow channel inlet (first flow channel inlet 158 or second flow channel inlet 164) becomes constricted by FOD during operation, the corresponding flow channel is not available to do heat transfer and the heat transfer surface area associated with the flow channel is wasted on the side that is blocked. Consequently, the performance of heat exchanger 114 may be reduced.

However, fin 154 advantageously defines at least one aperture 170 configured to allow fluid 172 to flow between first flow channel 156 and second flow channel 162 if one of first flow channel inlet 158 or second flow channel inlet 164 becomes constricted through FOD 176. In some examples, flow of fluid 172 in second flow channel 162 may be reduced because second flow channel inlet 164 is partially constricted, and second channel 162 may receive fluid 172 from first flow channel 156 to boost the flow of fluid 172 in second channel 162, which may improve heat transfer in core 115. In some examples, as illustrated for understanding, it is also considered that FOD 176 may constrict flow of fluid 172 through second flow channel inlet 164 such that no fluid 172 may flow into second flow channel 162. It is also considered that the flow of fluid 172 may be reduced, but not totally stopped. First flow channel inlet 158 may be relatively less constricted by FOD 176, and thus may pass a larger amount of fluid 172 through first flow channel 156 to perform heat transfer. In such example, absent at least one aperture 170 defined by fin 154, second flow channel 162 be an unutilized or underutilized portion of core 115. However, fluid 172 may flow through at least one aperture 170 from first flow channel 156 to second flow channel 162, thus mitigating thermal performance losses due to the constriction of second flow channel 164, because at least some fluid may flow through at least a portion of second flow channel 162 from at least one aperture 170 to second flow channel outlet 166.

Furthermore, in some examples, communication of fluid 172 between first flow channel 156 and second flow channel 162 through at least one aperture 170 may allow for easier release and/or automatic detachment of FOD 176 from second flow channel inlet 164. For example, as fluid 172 flows into second flow channel 162 through at least one aperture 170, the pressure of fluid 172 within second flow channel 162 may increase. Thus, the suction force on FOD 176 which keeps FOD 176 on core 115 at second flow channel inlet 164 may be reduced. As this suction force is reduced, more FOD 176 may detach from the face of core 115 at inlet manifold 174. Core 115 may therefore be less likely to become constricted by FOD 176 and/or stay constricted by FOD 176 by inclusion of fin 154 which defines at least one aperture 170.

In some examples, due to the constriction of second flow channel inlet 164 with FOD 176, a reduced fluid pressure of fluid 172 in second flow channel 162 relative to first channel 156 may drive fluid 172 to pass through at least one aperture 170 from first channel 156 into second channel 162. Additionally, or alternatively, as will be discussed below with respect to FIGS. 4A-5 a primary driver for the flow of fluid 172 across fin 154 may be inertia due to the momentum of fluid 172 in first flow channel 156.

Fin 154 may define first end 178 and second end 180. In some examples, as illustrated in FIG. 3A, fin 154 may extend substantially linearly (e.g., linearly or nearly linearly) in the X-direction from first end 178 to second end 180, which may be called a "straight or plain fin" architecture. Other architectures are considered where the fin may not define a linear shape in the X-direction, as will be described below with respect to the "wavy fin" architecture. Example "wavy fin" architectures will be described below with respect to FIGS. 4A-5. Fin 154 defines fin length $L_F$, measured along the X-axis from first end 178 to second end 180.

In some examples, at least one aperture 170 may be a plurality of apertures defined along the entire fin length. However, at least one aperture 170 may be positioned advantageously to maximize the efficiency of heat exchanger 114 while mitigating losses due to FOD 176 constriction. For example, fin 154 may define solid fin portion SP1, which is a portion of fin length $L_F$ of fin 154 that does not define any apertures through fin 154. Solid fin portion SP1 may be located at a downstream end, relative to the flow of fluid 172 from inlet manifold 174 to outlet manifold 176, of fin 154. Solid fin portion SP1 may define length $L_{SP1}$, which may extend, for example, from about the midpoint along fin length $L_F$ to second end 180. As such, after fluid 172 enters second flow channel 162, fin 154 may be solid, which may advantageously increase heat transfer area of fin 154, minimize swirling of fluid 172, or the like. In some examples, the ratio of the length of solid fin portion $L_{SP1}$:$L_F$ may be in a range from about 0.5:1 to about 0.9:1, such as about 0.8:1 to about 0.9:1. In some examples, Solid fin portion SP1 may be a first solid fin portion of a plurality of solid fin portions disposed along fin length $L_F$ of fin 154.

Fin 154 may further define porous fin portion PP, which is a portion of fin length $L_F$ of fin 154 that defines one or more apertures 170 through fin 154. In some examples, as illustrated, the one or more apertures 170 in porous fin portion PP may be a single aperture. Alternatively, porous fin portion PP may define a plurality of apertures, such as two, three, four, or more than four apertures. Porous fin portion PP may define a length $L_{PP}$ along fin length $L_F$ between first end of porous fin portion 182, which is closer to first end 178 of fin 154, and a second end of porous fin portion 184, which is the end of porous fin portion PP that is closer to second end 180 of fin 154. In some examples, the ratio of length $L_{PP}$:$L_F$ may, in some examples, be in a range of from about 0.01:1.0 to about 0.5:1.0.

Fin 154 also defines a fin height $H_F$ in the Z-direction. In some examples, in addition to or in the alternative to being defined along length $L_F$ of fin 154, porous fin portion PP may be defined along the height of fin 154. For example, a ratio of $H_{PP}$:$H_F$ may be between about 0.7:1.0 and about 0.9:1.0. Sizing porous portion along height $H_F$ of fin 154 in this way may feed fluid 172 into blocked passage 172 while maintaining the required structural integrity of fin 154.

In some examples, porous fin portion PP may be positioned advantageously along fin length $L_F$. For example, first end of porous fin portion 182 may be positioned closer to first end 178 of fin 154 than second end 180 of fin 154, such as between about 0% and about 20% of $L_F$ from first end 178 of fin 154. In some examples, the distance between first end 178 of fin 154 and first end 182 of porous fin portion PP may be between about 0.25 inches and about 4.0 inches, such as for example about 0.5 inches and about 1.0 inch. As such, fin 154 may define second solid fin portion SP2, which has length $L_{SP2}$ defined between first edge 178 of fin 154 and first edge 182 of porous fin portion PP. Positioning porous fin portion PP along fin 154 in this way may advantageously allow for a larger portion of the length of second flow channel 162 to receive fluid 172 and be used for heat transfer during operation, and inclusion of second solid fin portion SP2 may position at least one aperture 170 remotely enough from flow channel inlets 158, 164 to mitigate constriction of at least one aperture 170. Advantageously, inclusion of at least one aperture 170 defined by fin 154 into core 115 may open core 115, resulting in a lower pressure drop across core 115 as more of core 115 is available for flow of fluid 172.

In some examples, as mentioned above, first flow channel 156 defines flow channel width $L_W$. Flow channel width $L_W$ may be of any suitable magnitude, and may be selected according to the heat transfer requirements, pressure drop requirements, and/or fin density of heat exchanger 114. As discussed above, at least one aperture 170 of porous fin portion PP may be a single aperture 170 which defines aperture width D. Aperture width D may be defined as the greatest distance between any opposing edges of aperture 170. In some examples, aperture width D may have a greater magnitude than first flow channel width $L_W$. Arranging core 115 in this way may beneficially mitigate the likelihood that at least one aperture 170 becomes constricted during operation of heat exchanger 114, because any particle of FOD 176 (e.g., a pebble) that enters first flow channel 156 through first flow channel inlet 158 may subsequently pass-through aperture 170 without constricting or blocking aperture 170 since aperture 170 may be large enough to accommodate such a particle. In some examples, aperture width D may be between about 0.01 inches to about 0.2 inches to about 0.02 inches to about 0.1 inches. Although illustrated and primarily described herein as substantially circular, it should be noted that at least one aperture 170 may have any suitable geometric shape. Some non-limiting examples for the shape of at least one aperture include quadrilateral, hexagonal, elliptical, hemispherical, oval-shaped, or the like. In some examples, aperture width D allow FOD 176 particles with a diameter of 0.040 inches to pass through core 114.

At least one aperture 170 defined in fin 154 may, in some examples, provide for efficiency mitigation of losses due to FOD contamination. A combination of at least one aperture defined in fin 154 may be advantageously used in combination with other FOD mitigation techniques to capture further benefits. Some complementary FOD mitigation techniques may include, but are not limited to, FOD shields, FOD filters, FOD screens, FOD Fins and combinations thereof, or the like. However, unlike many other solutions which add components and thus increase the weight and volume of heat exchanger 114 to manage or mitigate FOD, the inclusion of at least one aperture 170 in fin 154 may advantageously reduce the weight of heat exchanger 114 by removing relatively dense metallic material from core 115 in select areas designed to improve the efficiency of heat exchanger 114 in extreme environments.

Figure 4A:
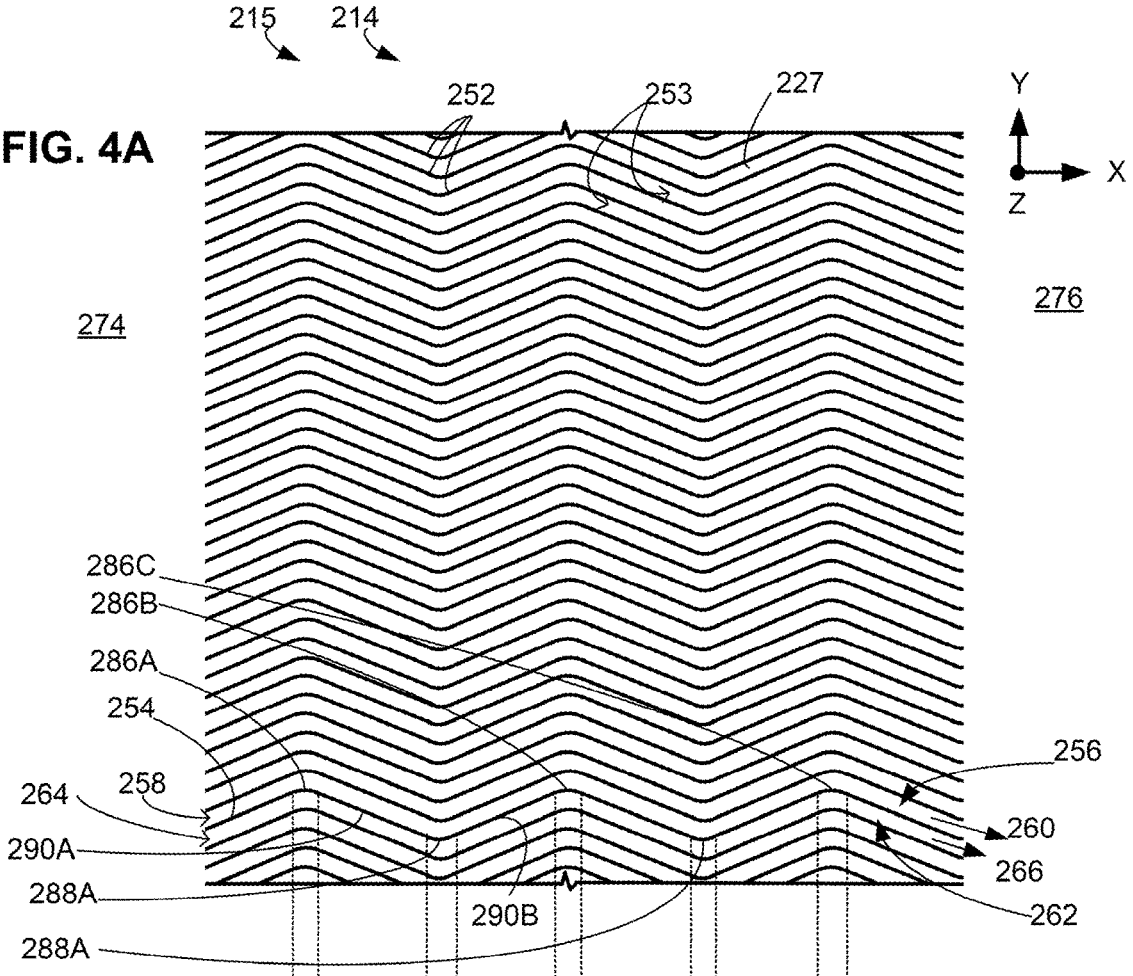
FIGS. 4A-4B illustrate a portion of an example heat exchanger which includes a wavy fin that defines one or more apertures configured to allow for cross-channel communication, according to some examples of the present disclosure.
Figure 4B:
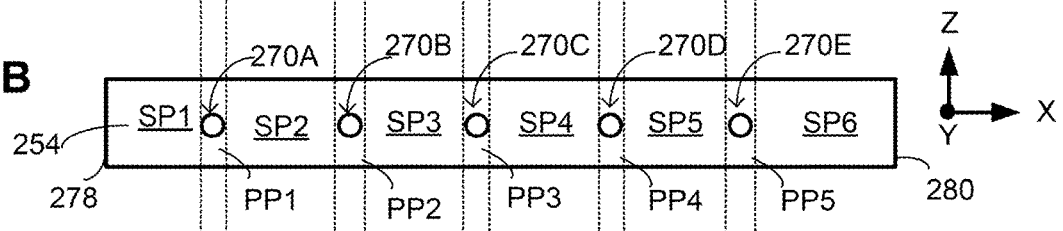

FIGS. 4A and 4B illustrate example core 215 of heat exchanger 214. Core 215 may be an example of core 15 from FIG. 1. Core 215 of FIGS. 4A-4B may be generally described similarly to core 115 of FIGS. 3A-3B, differing as described below, where like reference characters illustrate like elements.

Figure 5:
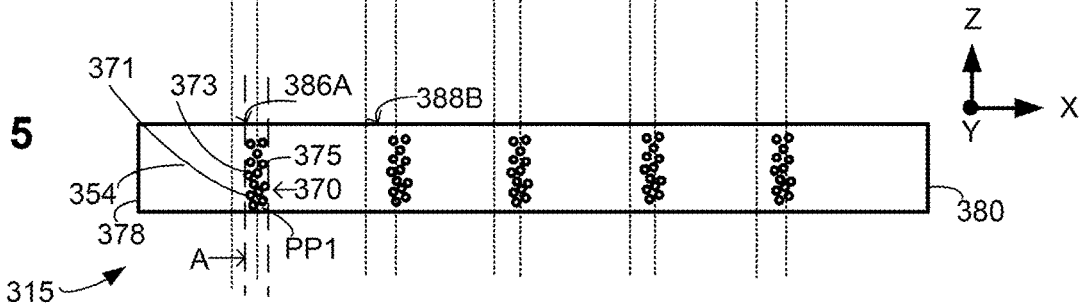
FIG. 5 illustrates an example fin of an example heat exchanger, according to some examples of the present disclosure.

FIG. 4A is a conceptual top view of a portion of an example core 215 and example associated fins 252. Example fins 252 may be examples of hot fins 26 or example cold fins 28 of FIG. 2. FIG. 4A illustrates fins 252 from a top view, located on top of tube sheet 227. FIG. 4B illustrates example fin 254 of plurality of fins 252 from a side view. FIG. 5 illustrates example fin 354 of plurality of fins 252 from a side view. Reference lines connecting FIGS. 4A to FIGS. 4B and 5 are illustrated for understanding of the position of porous fin portions on fin 154 relative to the peaks and valleys defined by fin 254.

In this example, core 215 of heat exchanger 214 has a "wavy fin" architecture. As such, wavy fin 254 defines a series of peaks 286A, 286B, 286C (collectively "peaks 286"). Peak 286A may be defined as a point defining a local extremity of wavy fin 254 toward the top of the page in the Y-direction. Wavy fin 254 may also define a series of valleys 288A, 288B (collectively "valleys 288"). Valley 288A may be defined as a point of local extremity of wavy fin 254 toward the bottom of the page in the Y-direction opposite peaks 286. As such, wavy fin 254 may not be linear along the X-axis, rather varying between peaks 286 and valleys 288 and wavy fin 254 extends from inlet manifold 274 and outlet manifold 276.

Wavy fin 254 is configured to change the direction of flow of fluid (172, FIG. 3A, not illustrated in FIG. 4A) through first flow channel 256 and/or second channel 262 one or more times as fluid 272 flows through core 215, which may beneficially improve heat transfer within core 215. Without wishing to be bound by theory, wavy fin 254 may improve heat transfer by encouraging interaction (e.g., contact) of fluid (172, FIG. 3A) with heat transfer surfaces (e.g., fins 252, tube sheet 227) and/or increasing the residence time of fluid (172, FIG. 3A) within core 215 such that further heat transfer can take place over a longer distance traveled and/or over a longer duration.

In some examples, wavy fin 254 may define any suitable shape as it extends between inlet manifold 274 and outlet manifold 276, defining peaks 286 and valleys 288. For example, wavy fin may include linear segments disposed angularly to each other, or define a substantially sinusoidal shape, a curvilinear shape, or combination of shapes as it extends between inlet manifold 214 and outlet manifold 276. In some examples, wavy fin 254 may define relatively straight lengths 290A, 290B (collectively, "relatively straight lengths 290"), which may be disposed between adjacent peaks 286 and valleys 288. It should be noted that although illustrated and discussed herein as relatively straight lengths 290, relatively straight lengths 290 of fin 254 need not be linear, and may only be relatively less inducing of a change of direction of fluid (172, FIG. 3A) than peaks 286 and valleys 288.

In some examples, core 215 may be configured such that relatively straight length 290A is disposed between peak 286A and valley 288A, relatively straight length 290 is disposed between valley 288A and peak 286B, and so on. Accordingly, in operation, fluid (172, FIG. 3A) may flow within first flow channel 256 along straight length 290A, change direction at valley 288A, and subsequently flow within first channel 256 along relatively straight length 290B until changing direction at peak 286B.

With concurrent reference to FIGS. 4A and 4B, in some examples, wavy fin 254 may include one or more porous fin portions PP1, PP2, PP3, PP4, PP5 (collectively "porous fin portions PP"). Each porous fin portion may define one or more than one aperture. For example, porous fin portion PP1 may define aperture 270A, porous fin portion PP2 may define aperture 270B, porous fin portion PP3 may define aperture 270C, porous fin portion PP4 may define aperture 270D, and porous fin portion PP5 may define aperture 270E. In like manner, solid portions SP1-SP6 may be defined along the length of wavy fin 254 between respective porous fin portions PP.

In some examples, as illustrated, one or more of porous fin portion PP, such as porous fin portion PP1, may be defined along a length of wavy fin 254 near a peak 286A of peaks 286 or a valley 288A of valleys 288. Inclusion of a porous fin portion PP1 which defines one or more apertures 170 near a peak 286A or a valley 288A may promote (e.g., improve) cross-channel communication of fluid (172, FIG. 3A) flowing through core 215, which may be desirable if first flow channel inlet 258 or second flow channel inlet 264 becomes constricted by FOD (176, FIG. 3A). Advantageously, the wavy fin arrangement of core 215 may be beneficial even if FOD (176, FIG. 3A) is not present, as the geometry of wavy fins 253 defining porous fin portion(s) PP may effectively introduce flow turbulence into those fin channels that are exhibiting semi-stagnate flow. For example, in addition to the reduced pressure in second channel 262 (in the example with constricted second flow channel inlet 264) causing fluid (172, FIG. 3A) to flow into second flow channel 262, the momentum of fluid (172, FIG. 3A) flowing in first flow channel 256 may drive fluid (172, FIG. 3A) through one or more apertures 270 in porous fin portion PP1 when porous fin portion PP1 is positioned near peak 286A or valley 288A. As discussed herein, porous fin portion PP1 may be considered to be near valley 288A when it is positioned between the midpoints of relatively straight portions 290A and 290B. In some examples, porous fin portion PP1 may be positioned along a length of wavy fin 254 that defines valley 288A. Furthermore, and advantageously, the wavy fin arrangement of core 215 may be beneficial even if FOD (176, FIG. 3A) is not present, as the geometry of wavy fins 252 defining porous fin portion(s) PP may effectively introduce flow turbulence into those flow channels 253 that may be exhibiting semi-stagnate flow.

In some examples, as illustrated, wavy fin 254 may define porous fin portions PP, and each porous fin portion PP may correspond to each peak 286A of peaks 286 and each valley 288A of valleys 288. Cross-channel communication may be even more improved in such examples. This effective cross communication will promote fluid (172, FIG. 3A) mixing and may improve heat transfer in core 215.

FIG. 5 illustrates example wavy fin 354 from a side view. Wavy fin 354 may be generally described as wavy fin 254 of FIG. 4B, differing as described below, where like reference characters indicate like elements.

In some examples, as mentioned above, porous fin portion PP1 may define more than one aperture, such as aperture 371, aperture 373, and aperture 375, (collectively, "apertures 370"). Apertures 370 may include any suitable number of apertures and may be arranged in any suitable sizes or shapes. For examples, apertures 370 may be small perforations in wavy fin 354 which may distribute fluid (172, FIG. 3A) as it crosses wavy fin 354 into the adjacent flow channel. Apertures 370 may be arranged in an orderly fashion, such as in rows and/or columns across the face of wavy fin 354, or may be distributed randomly.

Wavy fin 354 defines first end 378, second end 380, peak 386A, and valley 388B. It may be desirable, in some examples, to shift the location of porous fin portion PP1 downstream along arrow A (i.e. toward second end 380 of wavy fin 354) such that the center of porous portion PP1 is downstream of peak 386A. In some examples, as illustrated, porous fin portion PP1 may still be positioned near peak 386A along the length of fin 354. Positioning porous fin portion PP1 in this way may improve cross channel communication in core 315 by allowing a vector defined by the momentum of fluid (172, FIG. 3A) flowing in the second flow channel (262, FIG. 4A) to intersect with wavy fin 354 at a location at or near the center of porous fin portion PP1. Additionally, or alternatively, in some examples, porous fin portion PP1 may be shifted in a direction opposite arrow A such that PP1 may be defined in a location along wavy fin 354 configured such that fluid (172, FIG. 3A) flows past porous fin portion PP1 before peak 386A. Stated similarly, in some examples porous fin portion PP1 may be positioned upstream of peak 386A.

In some examples, wavy fin 354 may defines a fin surface area, which may be the area occupied by the fin along the X-Z plane. In some examples, a portion of the fin surface area defines apertures 370. In some examples, the area which defines apertures 370 may be between about 0.1% and about 20% of the fin surface area, such as between about 0.5% and about 5% of the fin surface area.

Figure 6:
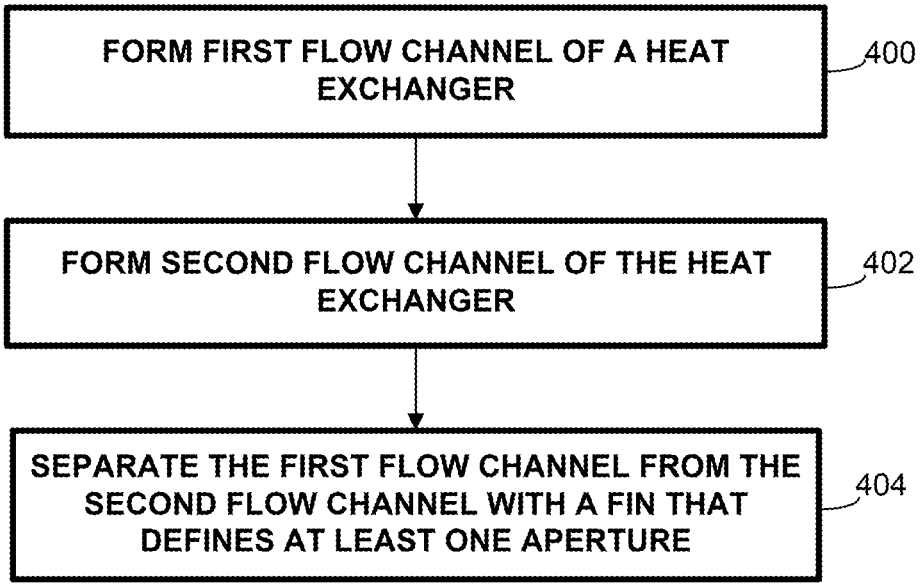
FIG. 6 is a flowchart illustrating an example technique for manufacturing a heat exchanger.

FIG. 6 is a flowchart illustrating an example technique for manufacturing a heat exchanger according to the present disclosure. Although described primarily with respect to heat exchanger 114 of FIG. 3A and heat exchanger 214 of FIG. 4A, techniques according to the present disclosure may be suitable for forming other heat exchangers, such as heat exchanger 14 of FIG. 1, and the described heat exchangers may be formed using other techniques.

With concurrent reference to FIGS. 3A and 3B, the technique of FIG. 6 includes forming first flow channel 156 of heat exchanger 114 (400). First flow channel 156 includes first flow channel inlet 158 and first flow channel outlet 160.

The technique of FIG. 6 also includes forming second flow channel 162 of heat exchanger 114 (402). Second flow channel 162 includes second flow channel inlet 164 and second flow channel outlet 166. The technique of FIG. 6 also includes separating first flow channel 156 from second flow channel 162 with fin 154 which defines at least one aperture 170 (404). At least one aperture 170 allows fluid 172 to flow between first flow channel 156 and second flow channel 162 if one of the first flow channel inlet 158 or second flow channel inlet 164 becomes constricted through a buildup of FOD 176 or other contaminants.

In some examples, fin 154 defines fin length $L_F$, and in some examples a portion of the fin length $L_F$ defines solid fin portion SP1 that does not define any apertures, and another portion of fin length $L_F$ defines a porous fin portion PP that includes at least one aperture 170. Turning to FIGS. 4A, 4B, and FIG. 6, in some examples wavy fin 254 defines a series of peaks 286 and valleys 288 along fin 254. Peaks 286 and valleys 288 may be configured to change the direction of flow of fluid (172, FIG. 3A) through first flow channel 256 and/or the second flow channel 262. In some examples, solid fin portion SP1 may be disposed along a relatively straight length 290A of wavy fin 254. In some examples, porous fin portion PP1 may be disposed along length of wavy fin 254 near peak 286A or valley 288A. In some examples, wavy fin 254 may define a plurality of porous fin portion PP, and each respective porous fin portion (PP1, PP2, PP3, PP4, PP5) may correspond to each respective peak and valley defined by wavy fin 254 (286A, 288A, 286B, 288B, 286C).

Referring back to FIG. 3B, in some examples, at least one aperture defined by porous fin portion PP may be a single aperture 170, and single aperture 170 may be defined by fin 154 in porous portion PP of fin 154 which is nearer to fluid inlet 174 than fluid outlet 176. In some examples, first flow channel 156 may define flow channel width $L_W$, the single aperture 170 may define single aperture width D, and single aperture width D may have greater magnitude than first flow channel width $L_W$. In some examples, the technique of FIG. 6 may further include manufacturing vehicle 12 (FIG. 1) with heat exchanger 14 as a component. In some examples, vehicle 12 may be an aircraft such as a helicopter.

The following numbered clauses illustrate one or more aspects of the devices and techniques described in this disclosure.

Clause 1: A heat exchanger comprising: a first flow channel having a first flow channel inlet and a first flow channel outlet; a second flow channel having a second flow channel inlet and a second flow channel outlet; and a fin separating the first flow channel from the second flow channel, wherein the fin defines at least one aperture configured to allow fluid to flow between the first flow channel and the second flow channel if one of the first flow channel inlet or second flow channel inlet becomes constricted through a buildup of foreign object debris.

Clause 2: The heat exchanger of clause 1, wherein the fin is a plain fin which extends substantially linearly from a first end to a second end.

Clause 3: The heat exchanger of clause 1 of clause 2, wherein the fin defines a fin length, wherein a portion of the fin length defines a solid fin portion that does not define any apertures, and wherein a portion of the fin length defines a porous fin portion including the at least one aperture.

Clause 4: The heat exchanger of any of clauses 1-3, wherein a first end of the porous fin portion is between about 0% and about 20% of the fin length away from a first end of the fin, and the porous fin portion is configured to reduce a pressure drop across a core of the heat exchanger.

Clause 5: The heat exchanger of clause 3, wherein the fin is a wavy fin defining a series of peaks and valleys along the fin length, the peaks and valleys configured to change the direction of flow through the first flow channel or the second flow channel, wherein the solid fin portion is disposed along a relatively straight length of the fin, and wherein the porous fin portion is disposed along length of the fin near a peak or a valley.

Clause 6: The heat exchanger of clause 5, wherein the fin defines a porous fin portion that corresponds to each peak and a porous fin portion that corresponds to each valley defined by the fin.

Clause 7: The heat exchanger of clause 3, wherein the solid fin portion is a first solid fin portion, the porous fin portion is a first porous fin portion, and the fin further defines a second solid fin portion and a second porous fin portion along the fin length.

Clause 8: The heat exchanger of any of clauses 1-7, wherein the at least one aperture is a single aperture, and the single aperture is defined by the fin in a portion of the fin that is nearer to the fluid inlet than the fluid outlet.

Clause 9: The heat exchanger of clause 8, wherein the first flow channel defines a flow channel width, the single aperture defines a single aperture width, and the single aperture width has greater magnitude than the first flow channel width.

Clause 10: The heat exchanger of any of clauses 1-9, wherein the heat exchanger is a component of an aircraft.

Clause 11: A method, the method comprising: forming a first flow channel of a heat exchanger, the first flow channel having a first flow channel inlet and a first flow channel outlet; forming a second flow channel of the heat exchanger, the second flow channel having a second flow channel inlet and a second flow channel outlet; and separating the first flow channel from the second flow channel with a fin, wherein the fin defines at least one aperture which allows the fluid to flow between the first flow channel and the second flow channel if one of the first flow channel inlet or second flow channel inlet becomes constricted through a buildup of foreign object debris.

Clause 12: The method of clause 11, wherein the fin is a plain fin which extends substantially linearly from a first end to a second end.

Clause 13: The method of clause 11 or clause 12, wherein the fin defines a fin length, wherein a portion of the fin length defines a solid fin portion that does not define any apertures, and wherein a portion of the fin length defines a porous fin portion including the at least one aperture.

Clause 14: The method of clause 13, wherein a first end of the porous fin portion is between about 0% and about 20% of the fin length away from a first end of the fin, and the porous fin portion is configured to reduce a pressure drop across a core of the heat exchanger.

Clause 15: The method of clause 13, wherein the fin is a wavy fin defining a series of peaks and valleys along the fin length, the peaks and valleys configured to change the direction of flow through the first flow channel or the second flow channel, wherein the solid fin portion is disposed along a relatively straight length of the fin, and wherein the porous fin portion is disposed along length of the fin near a peak or a valley.

Clause 16: The method of clause 15, wherein the fin defines a porous fin portion that corresponds to each peak and a porous fin portion that corresponds to each valley defined by the fin.

Clause 17: The method of clause 13, wherein the solid fin portion is a first solid fin portion, the porous fin portion is a first porous fin portion, and the fin further defines a second solid fin portion and a second porous fin portion along the fin length.

Clause 18: The method of any of clauses 11-17, wherein the at least one aperture is a single aperture, and the single aperture is defined by the fin in a portion of the fin that is nearer to the fluid inlet than the fluid outlet.

Clause 19: The method of clause 18, wherein the first flow channel defines a flow channel width, the single aperture defines a single aperture width, and the single aperture width has greater magnitude than the first flow channel width.

Clause 20: The method of any of clauses 11-19, wherein the heat exchanger is a component of an aircraft.

Various examples have been described. These and other examples are within the scope of the following claims.

What is claimed is:

1. A heat exchanger comprising:

a first flow channel having a first flow channel inlet and a first flow channel outlet;

a second flow channel having a second flow channel inlet and a second flow channel outlet; and a fin separating the first flow channel from the second flow channel, wherein the fin is a wavy fin defining a series of peaks and valleys along a length of the fin, the peaks and valleys configured to change a direction of flow through the first flow channel or the second flow channel, wherein:

a first portion of the length of the fin defines a first solid fin portion that does not define any apertures, and a second portion of the length of the fin defines a first porous fin portion defining a plurality of randomly distributed apertures, the first porous fin portion is configured to allow fluid to flow between the first flow channel and the second flow channel if one of the first flow channel inlet or second flow channel inlet becomes constricted through a buildup of foreign object debris, wherein the first porous fin portion is located such that a vector defined by a momentum of fluid flowing in the first flow channel or the second flow channel intersects with the wavy fin at a location at a center of the first porous fin portion, the first porous fin portion extends downstream along a length of the wavy fin from a first end of the first porous fin portion to a second end of the first porous fin portion, wherein the center of the first porous fin portion is downstream of a local peak or valley of the wavy fin, the first end of the first porous fin portion is aligned with a peak or a valley of the wavy fin, the first solid fin portion is disposed along a relatively straight length of the fin, and a second porous fin portion is displaced from the first porous fin portion by a second solid fin portion.

2. The heat exchanger of claim 1, wherein the first end of the first porous fin portion is between 0% and 20% of the length of the fin away from a first end of the fin, and the first porous fin portion is configured to reduce a pressure drop across a core of the heat exchanger.

3. The heat exchanger of claim 1, wherein the fin defines a porous fin portion that corresponds to each peak and a porous fin portion that corresponds to each valley defined by the fin.

4. The heat exchanger of claim 1, wherein the heat exchanger is a component of an aircraft.

5. A method, the method comprising:

forming a first flow channel of a heat exchanger, the first flow channel having a first flow channel inlet and a first flow channel outlet;

forming a second flow channel of the heat exchanger, the second flow channel having a second flow channel inlet and a second flow channel outlet; and separating the first flow channel from the second flow channel with a fin, wherein the fin is a wavy fin defining a series of peaks and valleys along a length of the fin, the peaks and valleys configured to change the direction of flow through the first flow channel or the second flow channel, wherein:

a first portion of the length of the fin defines a first solid fin portion that does not define any apertures, a second portion of the length of the fin defines a first porous fin portion defining a plurality of randomly distributed apertures, the first porous fin portion allows a fluid to flow between the first flow channel and the second flow channel if one of the first flow channel inlet or second flow channel inlet becomes constricted through a buildup of foreign object debris, the first porous fin portion is located such that a vector defined by a momentum of fluid flowing in the first flow channel or the second flow channel intersects with the wavy fin at a center of the first porous fin portion, the first porous fin portion extends downstream along a length of the wavy fin from a first end of the first porous fin portion to a second end of the first porous fin portion, wherein the center of the first porous fin portion is downstream of a local peak or valley of the wavy fin, the first end of the first porous fin portion is aligned with a peak or a valley of the wavy fin, the first solid fin portion is disposed along a relatively straight length of the fin, and a second porous fin portion is displaced from the first porous fin portion by a second solid fin portion.

6. The method of claim 5, wherein the first end of the first porous fin portion is between 0% and 20% of the length of the fin away from a first end of the fin, and the first porous fin portion is configured to reduce a pressure drop across a core of the heat exchanger.

7. The method of claim 5, wherein the fin defines a porous fin portion that corresponds to each peak and a porous fin portion that corresponds to each valley defined by the fin.

8. The method of claim 5, wherein the heat exchanger is a component of an aircraft.

9. The method of claim 5, wherein the plurality of randomly distributed apertures define between 0.5% and 5% of a total surface area of the wavy fin.

* * * * *